US006431138B1

(12) United States Patent
Kühne et al.

(10) Patent No.: US 6,431,138 B1
(45) Date of Patent: Aug. 13, 2002

(54) CYLINDER HEAD FOR AN INTERNAL COMBUSTION ENGINE WITH A PUMP-JET UNIT

(75) Inventors: Ingo Kühne, Braunschweig; Jens Hadler, Wolfsburg, both of (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 09/555,243

(22) PCT Filed: Oct. 16, 1998

(86) PCT No.: PCT/EP98/06579

§ 371 (c)(1),
(2), (4) Date: May 26, 2000

(87) PCT Pub. No.: WO99/28602

PCT Pub. Date: Jun. 10, 1999

(30) Foreign Application Priority Data

Nov. 26, 1997 (DE) ..... 197 52 381

(51) Int. Cl.[7] ..... F01M 9/10
(52) U.S. Cl. ..... 123/196 R
(58) Field of Search ..... 123/193.5, 196 R, 123/90.27, 90.31, 90.6, 90.33, 90.34, 196 M, 508

(56) References Cited

U.S. PATENT DOCUMENTS 5,052,351 A * 10/1991 Nishimura et al. ..... 123/193.5
5,778,841 A * 7/1998 Reedy et al. ..... 123/90.34

FOREIGN PATENT DOCUMENTS

DE 19814836 A1 * 10/1998
DE 19826286 A1 * 12/1999
GB 2090911 A * 7/1982
GB 2268543 A * 12/1994

* cited by examiner

*Primary Examiner*—Gene Mancene
*Assistant Examiner*—Hyder Ali
(74) *Attorney, Agent, or Firm*—Cohen, Pontani, Lieberman & Pavane

(57) ABSTRACT

A cylinder head for an internal combustion engine with at least one pump/nozzle unit, including at least one bearing block with a bearing half for a camshaft and with a bearing half for a rocker arm shaft for at least one rocker arm for actuating the pump/nozzle unit, a first separate lubricant supply duct provided in the cylinder head, and a second lubricant supply duct provided in the bearing block, a first end of the second lubricant supply duct being connected to the first lubricant supply duct and a second end of the second lubricant supply duct ending open in a bearing face of the bearing half for the rocker arm shaft.

9 Claims, 5 Drawing Sheets

CYLINDER HEAD FOR AN INTERNAL COMBUSTION ENGINE WITH A PUMP-JET UNIT

BACKGROUND OF THE INVENTION

1. Field of the Invention

The invention relates to a cylinder head for an internal combustion engine with pump/nozzle units, there being provided on the cylinder head at least one bearing block with a bearing half for a camshaft and with a bearing half for a rocker arm shaft for rocker arms for actuating the pump/nozzle unit.

2. Discussion of the Prior Art

A generic cylinder head is known from German reference DE 42 32 783 A1. A pump/nozzle unit is fastened to the cylinder head via a rocker arm shaft and bearing blocks for the rocker arm shaft, so that a fastening flange is dispensed with and the unit itself therefore projects only slightly laterally. German reference 196 34 541 A1 also discloses a method for producing a bearing arrangement of this type.

It is known from German reference 31 46 875 C2 to provide, in a rocker arm shaft itself, a lubricant path for supplying lubricant for a bearing part of the rocker arm. Furthermore, a bearing bed has formed in it a groove communicating with an annular gap which is located in a fastening screw and via which lubricant feed takes place. In order to reach a plurality of recesses arranged at a distance from one another and intended for supplying lubricant to different components, this groove must be produced with a sheet-like chamber-shaped extent. Due to this sheet-like character and due to a plurality of recesses branching off from the groove in order to feed lubricant to a plurality of components, the exact lubricant flow and the lubricant quantity conveyed in each case to the various points or the respective throughput cannot be predetermined accurately. Another disadvantage is that additional sealing measures have to be provided in the region of the screw surrounded by the annular gap, in order to prevent lubricant from escaping even when it is under high pressure.

SUMMARY OF THE INVENTION

The object on which the present invention is based is to provide an improved cylinder head of the above-mentioned type, in which the operating reliability of the structural unit consisting of camshaft, rocker arm shaft, rocker arms, pump/nozzle unit and charge cycle valves is increased in a simple way.

For this purpose, there is provision, according to the invention, for providing a first separate lubricant supply duct in the cylinder head and a second separate lubricant supply duct in the bearing block, a first end of the second lubricant supply duct being connected to the first lubricant supply duct and a second end of the second lubricant supply duct ending open in a bearing face for the rocker arm shaft.

The advantage of this is that a sufficient feed of lubricant to the rocker arm shaft is ensured in a simple manner, the lubricant feed being brought about without additional measures, at the same time as the mounting of the bearing block, by means of a connection of the first and second lubricant supply ducts. In contrast to an above-mentioned groove in the bearing bed, the second lubricant supply duct makes it possible to guide the lubricant in a directed manner to an exactly predetermined point, specifically the second end of the second lubricant supply duct, with a lubricant throughput which is exactly predetermined, inter alia, by a cross section of the lubricant supply duct, since there is no distribution over a large area, as in a groove, but a directed guidance of the lubricant in the duct. Furthermore, the arrangement of separate lubricant supply ducts avoids the need for a combination of screw bores in this region, so that additional sealing measures in the region of a screw orifice used as a lubricant path are unnecessary.

In order to supply the first lubricant supply duct with lubricant, the first duct is advantageously connected to a lubricant gallery.

A simple combination of only two different components in order to implement an arrangement for the actuation of pump/nozzle units during the production of internal combustion engines having different numbers of cylinders is achieved in that a rocker arm shaft is provided for the mounting of rocker arms for respective pump/nozzle units for two cylinders and a rocker arm shaft is provided for the mounting of rocker levers for respective pump/nozzle units for three cylinders. By an appropriate combination of only these two rocker arm shafts, internal combustion engines can be equipped with any desired number of cylinders, in particular with two, three, four, five, six, eight or twelve cylinders.

For the supply of lubricant to the camshaft, in a particularly advantageous way at least one third separate lubricant supply duct is formed in the cylinder head and is connected to a lubricant gallery or to the first lubricant supply duct and ends open in a bearing face of the camshaft in the cylinder head.

In order to supply lubricant to a secondary assembly in a simple way, furthermore, in a preferred embodiment of a cylinder head according to the invention, at least one fourth lubricant supply duct is formed in the cylinder head.

At the same time, a particularly simple arrangement which is particularly cost-effective to produce is achieved in that the fourth lubricant supply duct is connected to the oil gallery. The secondary assembly is, in this case, preferably a blower, an alternator and/or a water pump.

The rocker arms for the actuation of respective pump/nozzle units are expediently arranged between bearing blocks. This advantageously reduces a construction space taken up by the arrangement.

The lubricant is expediently oil.

For an optimum supply of lubricant to the rocker arm of the pump/nozzle unit, advantageously a fifth lubricant supply duct is formed in the rocker arm shaft and is connected to the second lubricant supply duct and conducts lubricant to a bearing point of the rocker arm of the pump/nozzle unit.

BRIEF DESCRIPTION OF THE DRAWINGS

Further features, advantages and advantageous refinements of the invention may be gathered from the dependent claims and from the following description of the invention with reference to the accompanying drawings, in which:

DETAILED DESCRIPTION OF THE PREFERRED EMBODIMENTS

Figure 1:
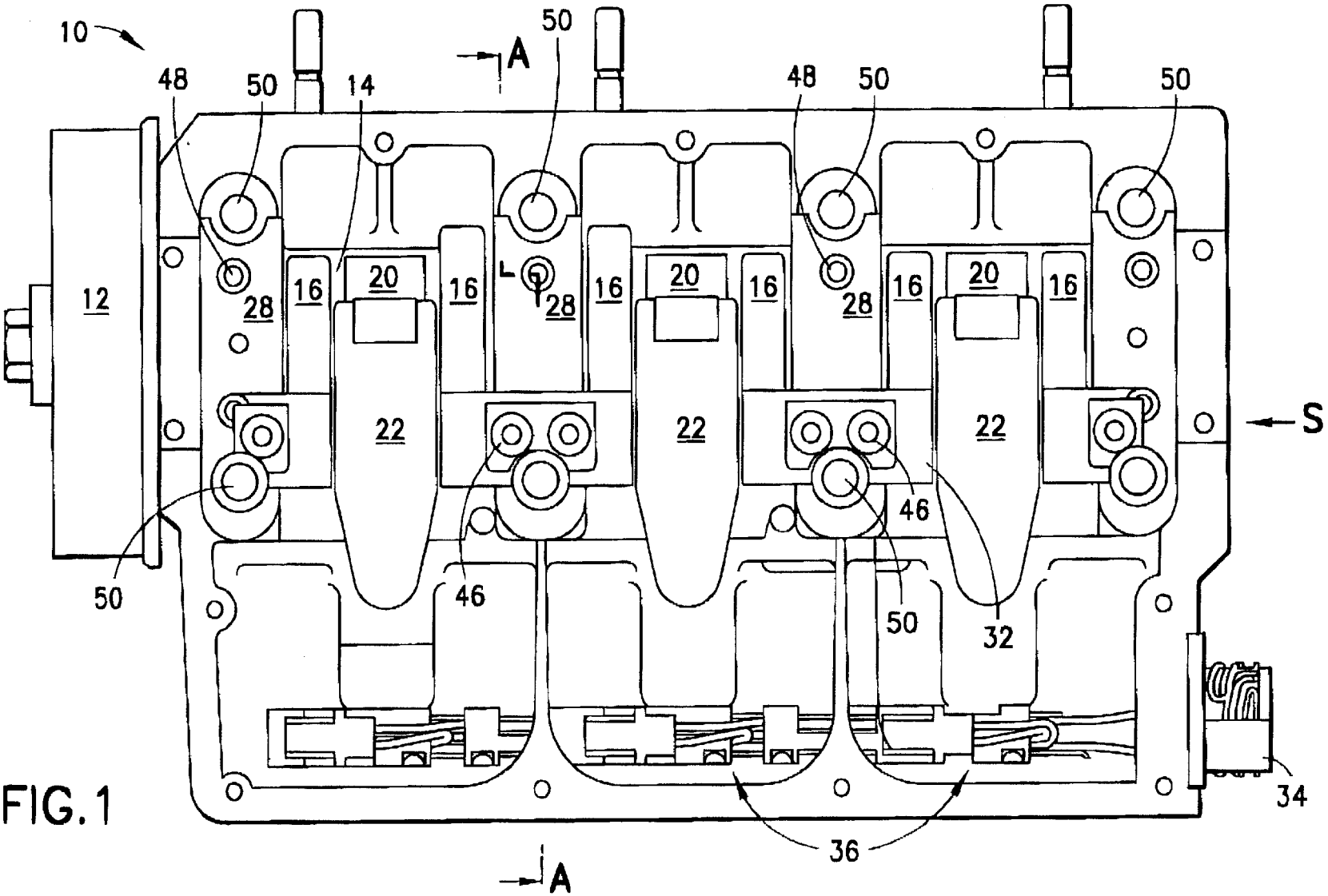
FIG. 1 shows a preferred embodiment of a cylinder head according to the invention in a top view.
Figure 2:
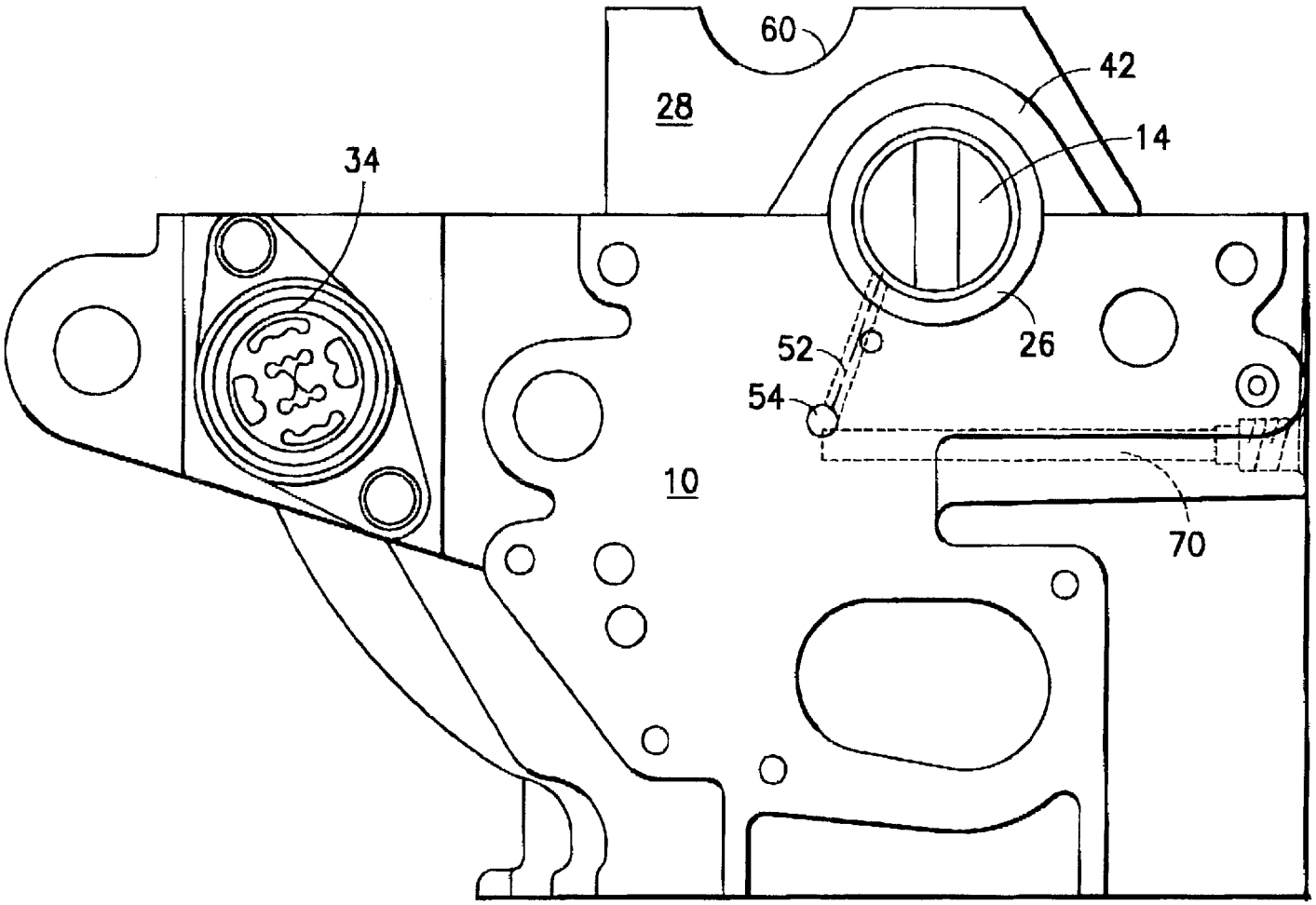
FIG. 2 shows the same in a view in the direction S of FIG. 1.
Figure 3:
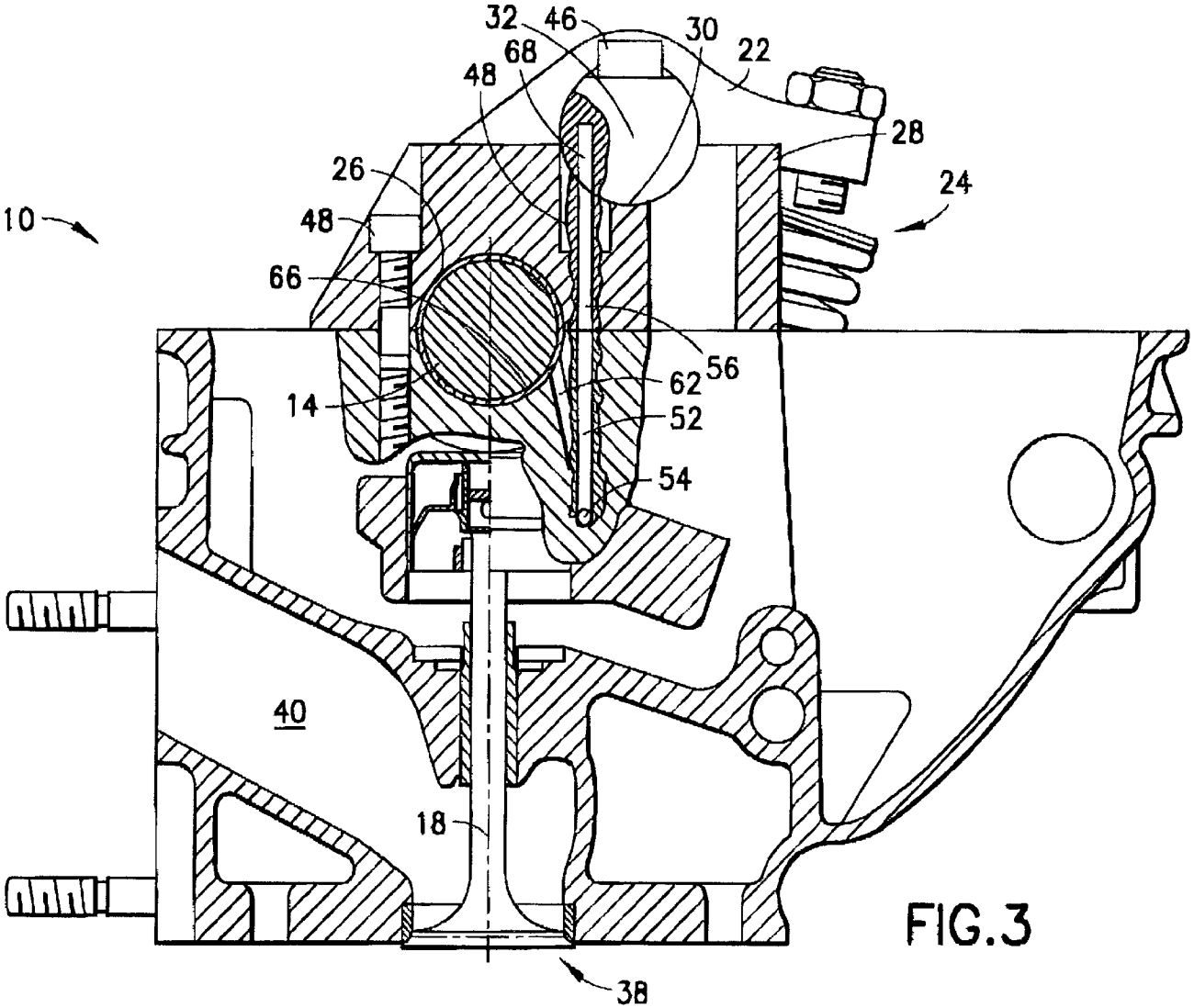
FIG. 3 shows the same in a sectional view along the line A—A of FIG. 1.

The preferred embodiment, illustrated in FIGS. 1 to 3, of a cylinder head 10 according to the invention comprises a camshaft timing gear 12, a camshaft 14 with cams 16 for the actuation of rocker arms (not illustrated) for bucket tappets 18 (FIG. 3) and with cams 20 for the actuation of rocker arms 22 which, in turn, actuate a respective pump/nozzle unit 24 indicated merely diagrammatically in FIG. 3.

As may be gathered particularly from FIG. 2, the camshaft 14 is mounted in a bearing 26, one half of which is formed by the cylinder head 10 and the other half of which is formed by a bearing block 28. Furthermore, the bearing block 28 has half of a bearing 30 for a rocker arm shaft 32 for the rocker arms 22 of the pump/nozzle units 24. The rocker arm shaft 32 is secured on the bearing block 28 by means of screws 46. Moreover, the bearing blocks 28 are fastened by means of screws 48 and the cylinder head 10 is mounted by means of cylinder head screws 50.

An electric connection means 34 (FIGS. 1 and 2) serves for the external connection of electric cabling 36 of the cylinder head 10. The bucket tappets 18 selectively open or close charge cycle valves 38 having respective air inlets and exhaust outlets 40 (FIG. 3). For the reinforcement and production of a symmetric bearing 30 for the rocker arm shaft 32, the bearing block 28 has a lateral extension 42 (FIG. 2). These are, for example, worked out of the one-piece bearing block 30 by metal cutting.

FIG. 3 shows a section essentially along the line A—A of FIG. 1, between which the sectional plane is not even in the direction perpendicular to the line A—A and perpendicular to the drawing plane of FIG. 1, but, instead, to illustrate various components which do not lie in one plane, likewise has stepped transitions. The section in FIG. 3 is selected in such a way that a refinement according to the invention for the supply of lubricant can be see in more detail. For this purpose, a first separate lubricant supply duct 52 is provided in the cylinder head 10 and is connected to a lubricant gallery 54 and supplied by the gallery 54 with lubricant, for example oil.

The term "separate lubricant supply duct" means, here, essentially that the lubricant supply duct is at a distance from all the screw bores or from other bores passing through the bearing block or the cylinder head. In other words, "separate" lubricant supply ducts are not combined with screw bores. The bearing block 28 has a second lubricant supply duct 56, the lower end of which in FIG. 3 is in alignment with the first lubricant supply duct 52 when the bearing block 28 is mounted, so that lubricant can flow from the first lubricant supply duct 52 into the second lubricant supply duct 56.

The second lubricant supply duct 56 in the bearing block 28 ends, with an orifice 58 located opposite the first lubricant supply duct 52, in a bearing face 60 of the bearing 30 in the bearing block 28. Lubricant is fed to the rocker arm shaft 32 via this orifice 58. A fifth separate lubricant supply duct 68 is formed in the rocker arm shaft 32 and is in alignment with the second lubricant supply duct 56 when the rocker arm shaft 32 is mounted, so that lubricant can flow from the second lubricant supply duct 56 into the fifth lubricant supply duct 68. This fifth lubricant supply duct 68 then guides the lubricant to a bearing point of the rocker arm 22 at which the rocker arm 22 executes a movement pivoting back and forth about the rocker arm shaft 32.

As is also apparent from FIG. 3, a third separate lubricant supply duct 62 is provided, which is connected to the lubricant gallery 54 or to the first lubricant supply duct 52 and which ends with an open end 64 in a bearing face 66 in the bearing half of the cylinder head 10. The bearing 26 of the camshaft 14 is supplied with lubricant along this path.

FIG. 2 also illustrates that a fourth separate lubricant supply duct 70 is provided in the cylinder head 10 and, on the one hand, is connected to the lubricant gallery 54 and, on the other hand, conducts lubricant to a secondary assembly, not illustrated, in order to supply lubricant to the secondary assembly.

Figure 4:
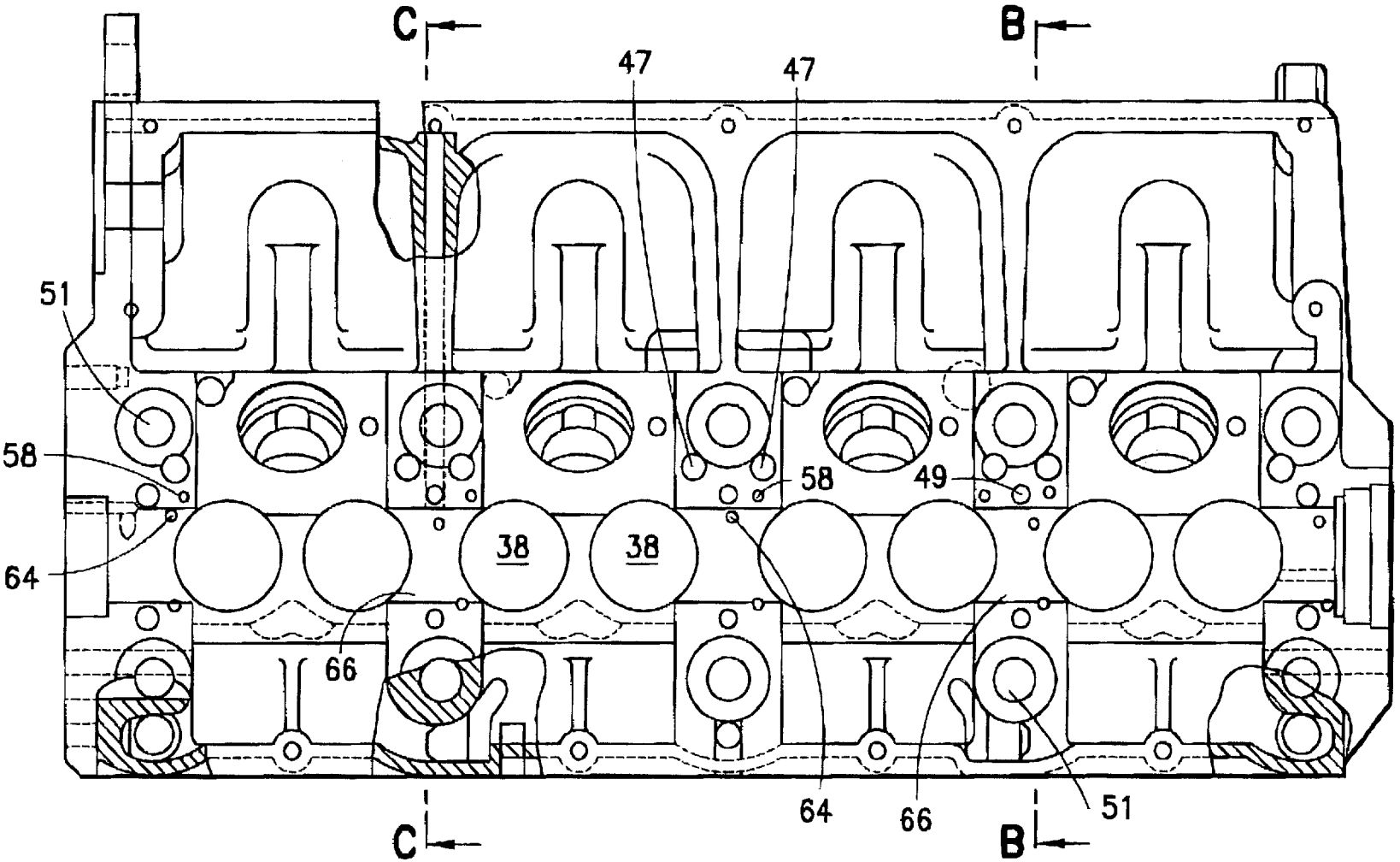
FIG. 4 shows the same in a partially sectional top view in the non-mounted state.

FIG. 4 shows the cylinder head 10 in the non-mounted state, that is to say without the camshaft, rocker arm shaft, bucket tappets, pump/nozzle units and bearing blocks. In the partially sectional top view of FIG. 4, the charge cycle valves 38 arranged in pairs, the orifice 58 of the second lubricant supply ducts 56, the bearing face 66 of the camshaft bearing 26 and the open ends 64 of the third lubricant supply duct 62 can be seen. 72 designates orifices into a combustion space, not illustrated in any more detail, of cylinders of the internal combustion engine, corresponding pump/nozzle units (not illustrated in FIG. 4) being arranged in said orifices. Corresponding screw holes 47, 49 and 51 for the screws 46, 48 and 50 illustrated in FIGS. 1 to 3 can be seen.

Figure 5:
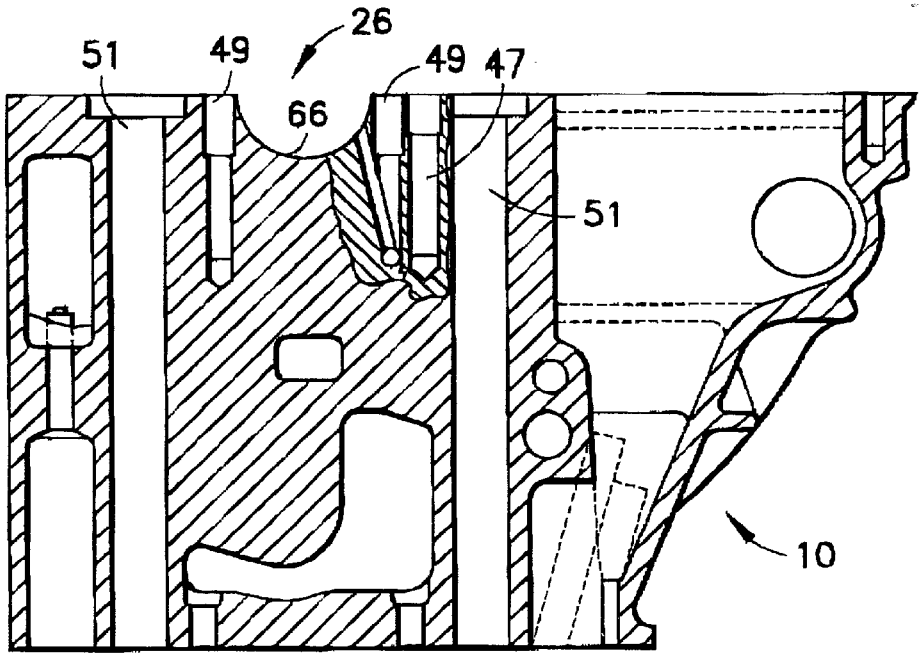
FIG. 5 shows the same in a sectional view along the line B—B of FIG. 4.
Figure 6:
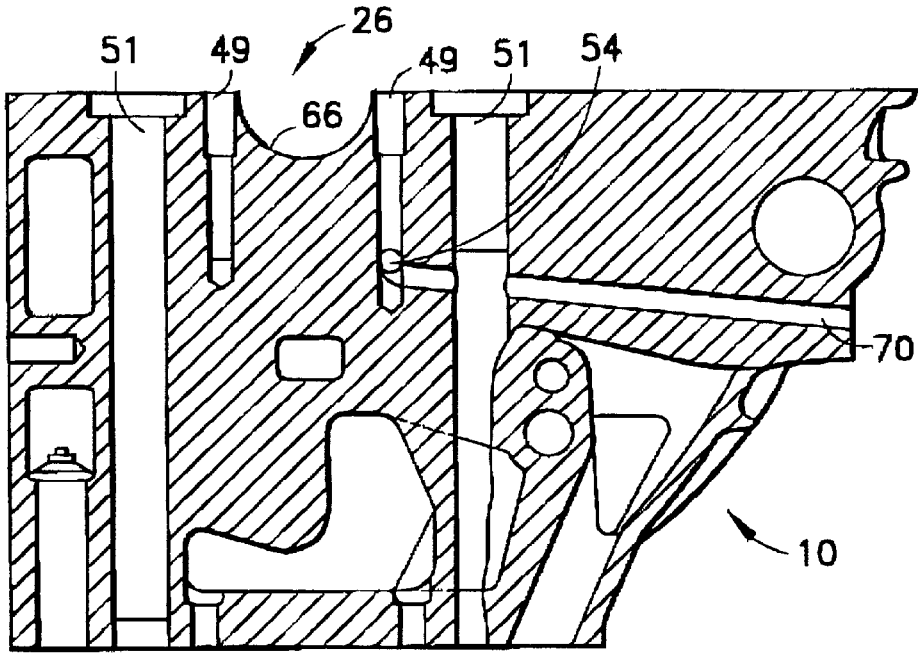
FIG. 6 shows the same in a further sectional view along the line C—C of FIG. 4.

FIG. 5 shows, in section along the line B—B of FIG. 4, the arrangement of the third lubricant supply duct 62 for feeding lubricant to the camshaft, not illustrated in FIG. 5, and FIG. 6 shows, in a section along the line C—C of FIG. 4, the arrangement of the fourth lubricant supply duct 70 for supplying lubricant to a secondary assembly, which is not illustrated. All the other components are given reference numerals corresponding to those in FIGS. 1 to 4, so that, for a more detailed description, reference is made to the statements made above with regard to FIGS. 1 to 4.

In the case of internal combustion engines with different numbers of cylinders, the production of the arrangement for the actuation of the pump/nozzle units, which comprises the rocker arm shaft 32 and rocker arms 22, is optimized in that only two different rocker arm shafts 32 of different length are provided: a shorter rocker arm shaft for the mounting of rocker arms for respective pump/nozzle units for two cylinders and a longer rocker arm shaft for the mounting of rocker arms for respective pump/nozzle units for three cylinders. In this case, the shorter rocker arm shaft 32 is mounted on three bearing blocks 28 and the longer rocker arm shaft 32 on four bearing blocks 28. By an appropriate combination of only these two different rocker arm shafts 32, internal combustion engines can be equipped with any desired number of cylinders, in particular with two, three, four, five, six, eight or twelve cylinders. Thus, for example in the case of a 5-cylinder engine, a rocker arm shaft 32 for three rocker arms 22 is combined with a rocker arm shaft 32 for two rocker arms 22, a joint between the two rocker arm shafts 32 being arranged in the bearing region of a bearing block 28. For this purpose, the respective lengths of the two rocker arm shafts 32 of different length are selected in such a way that they project only halfway into the two outer bearing blocks in each case.

What is claimed is:

1. A cylinder head arrangement for an internal combustion engine with a cylinder head having at least one pump/nozzle unit, comprising: at least one bearing block with a bearing half for a camshaft and with a bearing half for a rocker arm shaft for at least one rocker arm for actuating the pump/nozzle unit, the cylinder head and the bearing block having screw holes for fastening screws; a first separate lubricant supply duct provided in the cylinder head so as to be spaced and separate from the screw holes; a second lubricant supply duct provided in the bearing block so as to be spaced and separate from the screw holes, a first end of the second lubricant supply duct being in fluid communication with the first lubricant supply duct and a second end of the second lubricant supply duct ending open in a bearing face of the bearing half for the rocker arm shaft; and at least one third separate lubricant supply duct formed in the cylinder head and connected to the first lubricant supply duct, the third supply duct having an end that opens in a bearing face for the camshaft in the cylinder head.

2. A cylinder head arrangement as defined in claim 1, wherein two rocker arm shafts are provided including a first rocker arm shaft for mounting rocker arms for respective pump/nozzle units for two cylinders and a second rocker arm shaft for mounting rocker arms for respective pump/nozzle unit for three cylinders.

3. A cylinder head arrangement as defined in claim 1, and further comprising at least one-fourth lubricant supply duct formed in the cylinder head for supplying lubricant to a secondary assembly.

4. A cylinder head arrangement as defined in claim 3, wherein the secondary assembly is at least one of a blower, an alternator and a water pump.

5. A cylinder head arrangement as defined in claim 3, and further comprising a fifth lubricant supply duct formed in the rocker arm shaft and connected to the second lubricant supply duct so as to conduct lubricant to a bearing point of the rocker arm for the pump/nozzle unit.

6. A cylinder head arrangement as defined in claim 1, wherein a plurality of rocker arms for actuation of respective pump/nozzle units are provided and arranged between bearing blocks.

7. A cylinder head arrangement as defined in claim 1, wherein oil is the lubricant in the supply ducts.

8. A cylinder head arrangement for an internal combustion engine with a cylinder head having at least one pump/nozzle unit, comprising: at least one bearing block with a bearing half for a camshaft and with a bearing half for a rocker arm shaft for at least one rocker arm for actuating the pump/nozzle unit, the cylinder head and the bearing block having screw holes for fastening screws; a first separate lubricant supply duct provided in the cylinder head so as to be spaced and separate from the screw holes; a second lubricant supply duct provided in the bearing block so as to be spaced and separate from the screw holes, a first end of the second lubricant supply duct being in fluid communication with the first lubricant supply duct and a second end of the second lubricant supply duct ending open in a bearing face of the bearing half for the rocker arm shaft; a lubricant gallery connected to the first lubricant supply duct in the cylinder head; and at least one third separate lubricant supply duct formed in the cylinder head and connected to the lubricant gallery, the third supply duct having an end that opens in a bearing face for the camshaft in the cylinder head.

9. A cylinder head arrangement as defined in claim 8, and further comprising at least one-fourth lubricant supply duct formed in the cylinder head for supplying lubricant to a secondary assembly, wherein the fourth lubricant supply duct is connected to the lubricant gallery.

* * * * *